United States Patent [19]

Taylor et al.

[11] 4,346,643

[45] Aug. 31, 1982

[54] THERMAL JACKET FOR ELONGATED STRUCTURES

[75] Inventors: Peter F. Taylor, Agoura; Harold J. Tuchyner, Pacific Palisades; Algerd Basiulis, Redondo Beach; Thomas R. Lamp, Torrance, all of Calif.

[73] Assignee: Hughes Aircraft Company, Culver City, Calif.

[21] Appl. No.: 101,316

[22] Filed: Dec. 7, 1979

[51] Int. Cl.[3] ..... F41F 17/00

[52] U.S. Cl. ..... 89/14.1; 165/104.26

[58] Field of Search ..... 89/1 H, 14 A; 165/77, 165/105, 104.26

[56] References Cited

U.S. PATENT DOCUMENTS

| | | | |
|---|---|---|---|
| 1,942,082 | 1/1934 | Biancalana | 165/77 |
| 2,806,409 | 9/1957 | Purcella et al. | 89/14 A |
| 3,548,930 | 12/1970 | Byrd | 165/105 |
| 3,684,383 | 8/1972 | Johansson | 89/41 ME |
| 3,847,208 | 11/1974 | Ollendorf | 165/105 |
| 4,207,027 | 6/1980 | Barry | 165/105 |

FOREIGN PATENT DOCUMENTS

| | | | |
|---|---|---|---|
| 205570 | 9/1939 | Switzerland | 89/14 A |

OTHER PUBLICATIONS

Naval Ordnance, "123-Droop", 1921, p. 111.

*Primary Examiner*—Stephen C. Bentley
*Attorney, Agent, or Firm*—Lewis B. Sternfels; W. H. MacAllister; A. W. Karambelas

[57] ABSTRACT

An arrangement for reducing non-symmetrical, thermally induced strains in a gun tube (12) comprising a heat pipe jacket (18) in thermal engagement with the gun tube to provide both high radial and circumferential thermal conductance from the tube.

9 Claims, 7 Drawing Figures

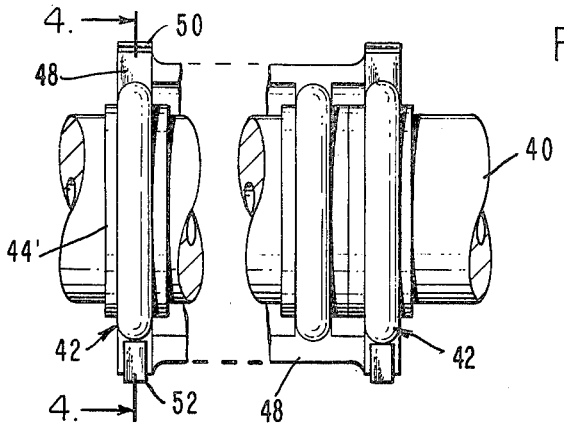
Fig. 3.
Fig. 4.
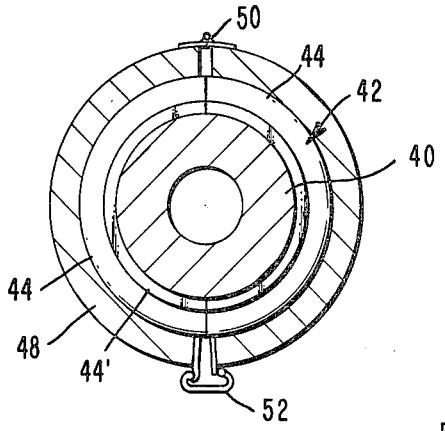
Fig. 5.
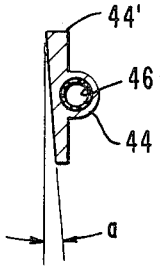
Fig. 6.
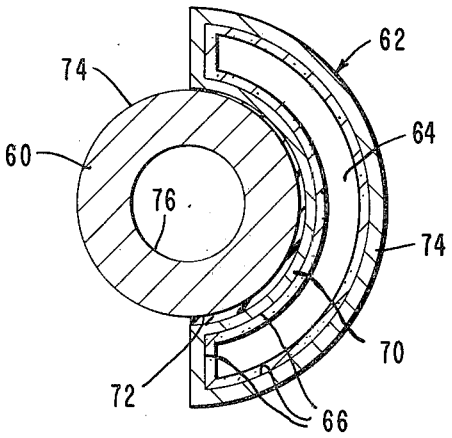

THERMAL JACKET FOR ELONGATED STRUCTURES

TECHNICAL FIELD

The present invention relates to an arrangement and method for reducing non-symmetrical, thermally induced strains in elongated structures, in particular, gun tubes by enclosing them in heat conducting jackets, such as heat pipe jackets, having both high radial and circumfertial conductance.

BACKGROUND ART AND OTHER CONSIDERATIONS

Inasmuch as the present invention was devised to overcome specific bending problems which occur in gun tubes, the following discussion will be directed to the solution of such problems; however, it is to be understood that the concepts of the present invention are as applicable to any elongated structure which is subject to non-symmetrical thermal environments, which create non-symmetrical strains in the elongated structure.

Circumferential temperature gradients are readily established in gun tubes when exposed to non-symmetrical thermal environments, which can be produced by such factors as sunlight, wind and rain, singly or in combination. Such environments produce non-symmetrical strains in the tube, causing it to bend about its axis and, therefore, to significantly reduce the gun's firing accuracy.

This problem, of gun tube bending can be better appreciated if described analytically. The angular deflection $\phi$ of a beam segment of diameter D and length L due to a diametrical temperature difference $\Delta T$ is given simply by:

$$\phi = \frac{\alpha L \Delta T}{D}$$

where $\alpha$ is the linear coefficent of thermal expansion of the beam material. As an example, a typical tank gun tube has the following parameters: L=16 feet, D=6 inches, and $\alpha = 6 \times 10^{-6}$ per °F. Using these figures, $\phi = 0.197\Delta T$ mrad. This implies that a diametrical temperature gradient of only 0.5° F. can induce an angular deflection of 0.1 mrad. Such temperature gradients, and indeed significantly higher ones, can readily be induced in a gun tube exposed to an asymmetrical thermal environment, such as is encountered in the field due to sun and wind.

This problem is known, and existing thermal jacket designs have been devised to attenuate these temperature gradients and, therefore, to minimize the effect of such thermal disortion by use of highly insulating materials. For example, one jacket includes alternate layers of aluminum and fiber glass wrapped around the gun tube. The purpose of the fiber glass is to provide insulation from the environment while the aluminum is used in an attempt further to reduce circumferential gradients by increasing the circumferential conductance. Such thermal jackets do reduce temperature gradients but can cause excessive heating of the tube under conditions of of rapid firing because their design is intended to provide a high radial thermal impedance between the gun tube and the environment.

A parametric study involving thermal insulating blankets having a wide range of thermal characteristics was made in the following manner.

First, a thermal jacket was assumed to have a thermal conductivity such that its total radial thermal impedance ($R_B$) was an integer multiple of the gun tube radial thermal impedance ($R_G$). In addition, the jacket conductance was assumed to be isotropic, i.e., the radial and circumferential thermal conductivities of the jacket were equal.

Then, for each jacket radial conductivity value, the circumferential conductivity was increased to simulate an anisotropic jacket such as might be obtained with alternate rings of an insulating material and a metal.

The parametric study covered a range of values for $R_B/R_G$ from 2 to 1000. Circumferential conductivity of the jacket was limited to 156 BTU/hr-ft-°F. The case for a bare gun tube was also included.

The results of the analysis of conventional thermal jackets produced some significant results and are summarized in the following conclusions. First, until the ratio ($R_B/R_G$) of the radial thermal impedance of the jacket to the radial thermal impedance of the gun tube exceeds a critical value, which depends upon gun tube dimensions, the addition of a thermal jacket will aggravate the problem of gun tube bending by thermally coupling the gun tube more, rather than less, to the external environment. This results because the increased surface area is not offset by the added thermal insulation. Accordingly, the thermal coupling to the asymmetrical thermal environment is enhanced and not reduced. Second, to be effective, an isotropic jacket of low thermal conductivity must have a very high thermal impedance where $R_B/R_G$ is on the order of at least 100 to 200. As a result, excessive heating of the barrel, which is not a desirable feature, can occur when the gun is fired at a high rate, at least because gun tube wear substantially increases as the overall tube temperature increases. Moreover, it was found that an increase in the circumferential conductivity of a highly insulative jacket has a negligible effect upon the temperature gradient between opposite sides of the tube. Third, if the circumferential conductivity is high, the jacket can be very effective even if, contrary to the accepted prior art belief, the radial conductivity is high. This infers that a solid metal jacket, although not practical, would be effective in reducing gradients while at the same time allowing for good thermal dissipation under conditions of rapid fire. Therefore, a thermal jacket which would exhibit improved characteristics over those in existence should have both high radial and circumferential conductance rather than a low radial and high circumferential conductance.

SUMMARY OF THE INVENTION

The present invention exhibits such improved characteristics and avoids the above-noted and other problems associated therewith by placing one or more annular heat pipes or other thermal conductive devices of tubular or toroidal configuration along the length of and in thermal engagement with the gun tube or other elongated structure.

It is, therefore, an object of the present invention to reduce circumferential temperature gradients of such elongated structures to acceptable levels.

Another object is to enhance heat dissipation from the elongated structure to the environment.

Another object is to provide for negligible radial thermal impedance in such elongated structures.

Another object is to reduce circumferential temperature gradients to $\frac{1}{2}$° F. or less, resulting in angular deflections of 0.1 mR or less.

Another object is to reduce axial thermal gradients in gun tubes or other elongated structures.

Another object is to provide for such a means of thermal control for gun tubes which remains effective despite possible partial inactivation or destruction of portions of the thermal control system.

Other aims and objects as well as a more complete understanding of the present invention will appear from the following explanation of exemplary embodiments and the accompanying drawings thereof.

BRIEF DESCRIPTION OF THE DRAWINGS

FIG. 3 is a view of a second embodiment of the present invention configured as a series of toroidal heat pipes;

FIG. 4 is a cross-section taken along lines 4—4 of FIG. 3;

FIG. 5 is a cross-section of one toroidal heat pipe;

FIG. 6 is an illustration of a portion of the heat pipes of either of the prior embodiments showing greater detail of one of the heat pipe constructions.

DETAILED DESCRIPTION OF THE INVENTION

As is commonly understood, a heat pipe is a closed chamber lined with porous material to provide a capillary structure, with sufficient volatile fluid therein to saturate the porous lining or wick. It operates to take advantage of the latent heat of vaporization of the fluid so that, when heat is applied to one portion of the chamber wall, working fluid is evaporated to carry away the heat. The vapor moves from the heated portion of the tube to the cooler portion where it condenses to release the heat. The condensate is then absorbed by the wick and, by capillary action, is returned to the hot end of the tube to replace the fluid being evaporated. The heat pipe, therefore, has a characteristic isothermal nature which makes it singularly suitable for applications requiring high degrees of temperature uniformity.

Figure 1:
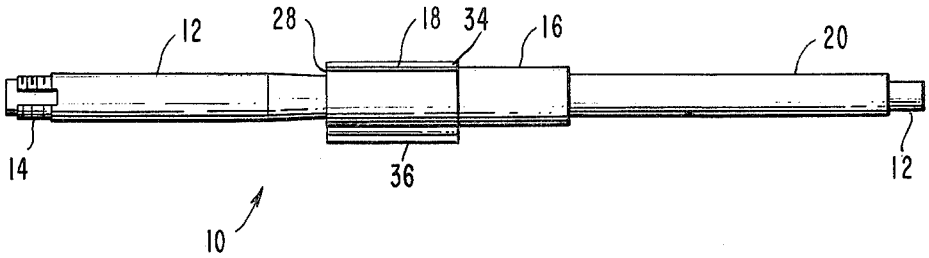
FIG. 1 depicts a first embodiment of the invention configured as a tubular heat pipe.

In FIG. 1, an assembly 10 comprises a gun tube 12 connected to a tank or other vehicle at its end 14. The gun tube may be provided with a bore evacuator 16 to vent projectile impelling gases, as is conventional in the art. Surrounding the gun tube are a pair of heat pipes 18 of different lengths, which are designed to jacket the gun tube over substantially its full length.

Figure 2:
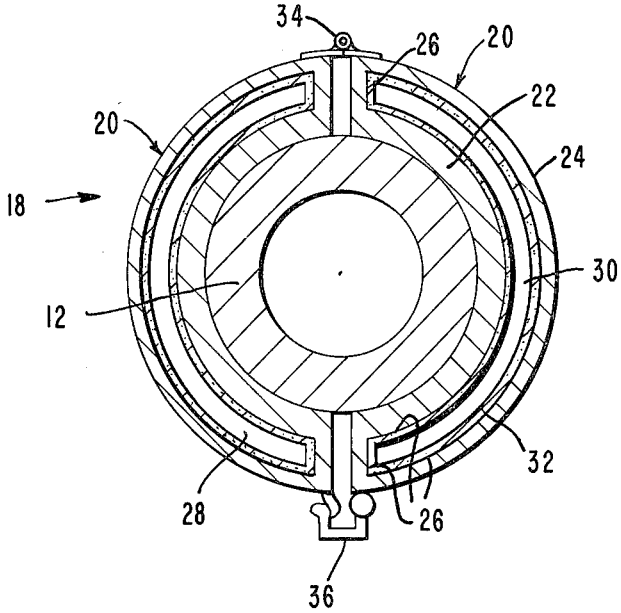
FIG. 2 is a section taken along lines 2—2 of FIG. 1.

As shown in FIG. 2, each heat pipe comprises a pair of arcuate envelopes 20 pivotally joined by one or more hinges 34 at one end and one or more toggle clamps 36 or similar mechanisms at their other end. Each envelope comprises an inner wall 22, an outer wall 24, and side and end walls 26 and 28 to provide a completely enclosed chamber defining a vapor space 30 therein. Each arcuate heat pipe portion 20 is further provided with a wick structure 32 formed on its internal walls. Hinge 34 permits placement of the arcuate portions around the gun tube. Toggle clamp 36 secures portions 20 together in thermal and physical contact with the gun tube.

A slightly different embodiment is depicted in FIG. 3 in which a gun tube 40 is surrounded by a plurality of toroidal heat pipes 42, each comprising arcuate portions 44 with a wick 46 (see FIG. 5) on all of their internal surfaces. To secure all heat pipe tori to the gun tube, each pair of arcuate tube portions 44 are joined by any suitable permanent attachment respectively to a pair of clam-shell brackets 48. The brackets are joined together at their respective ends by a pivot or hinge 50 and a clamp 52 in a manner similar to that described above with respect to FIGS. 1 and 2. As shown in FIG. 5, a slight taper denoted by angle a is made in foot 44' of portions 44 so that the heat pipes will fit as closely as possible to the taper of the gun tube. A similar taper may be utilized for the tubular heat pipes shown in FIGS. 1 and 2.

In the embodiment of FIGS. 1 and 2, the tubular heat pipe assembly can be manufactured in multiple sections to separate the entire jacket into individual compartments, so that damage to any limited number of sections would not promote failure of the entire jacket.

The second embodiment of FIGS. 3–5 may be constructed from flanged aluminum tube extrusions, which are interconnected into a small number of separate structural parts by brazed flanges which structurally group the individual toroidal tubes. The second embodiment enables the individual compartmentalized concept of FIG. 1 to be reduced to mass production techniques. Such individual compartmentalization is peculiarly suitable to warfare environments where shrapnel or other debris might puncture and thereby destroy proper operation of the heat pipe; however, destruction of a few segments would not destroy the entire function of other non-injured compartments.

Figure 7:
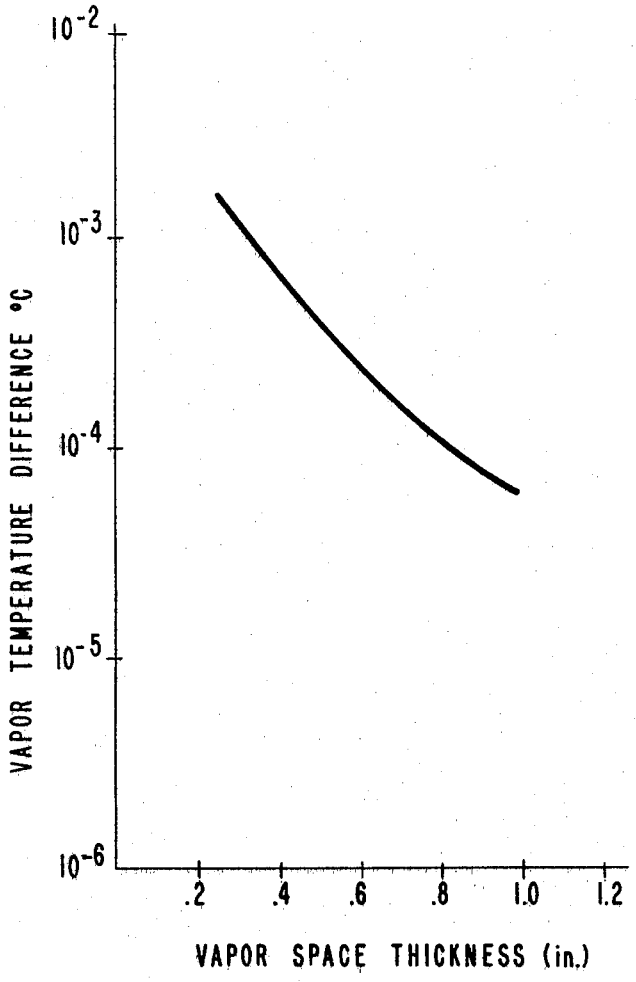
FIG. 7 is a graph for a particular working fluid depicting vapor temperature difference verses vapor space thickness.

The performance of the present invention may be analyzed with respect to FIGS. 6 and 7. For this application as shown in FIG. 6, a gun tube 60 is depicted with a single arcuate heat pipe portion 62 having a vapor space 64 and a wick 66 on its interior surfaces formed on its condenser and evaporator walls 70 and 74 and side and end walls. The overall heat pipe temperature drop can be characterized as:

$$\Delta T_{oa}=(T_{ew}-T_v)+\Delta T_v+(T_v-T_{cw}),$$

where $T_{oa}$=temperature of the overall heat pipe (62)

$T_{ew}$=temperature of the evaporator wall (74)

$T_v$=temperature of the vapor in space (64)

$T_{cw}$=temperature of the condenser wall (70)

Since it is desired to isothermalize the gun tube circumference and since only the condenser section at inner wall 70 of the heat pipe is in contact with it, the term $(T_{cw}-T_v)$ may be neglected.

The smallest temperature drop in most heat pipe systems occurs in the vapor because of the effects of the pressure drop due to viscous flow losses in the working fluid vapor. By combining the Hagen-Poisenille Law for viscous flow with the Clausius-Clapeyron equation, the following equation for vapor temperature drop is derived:

$$\Delta T = \frac{RT^2}{h_{fg}}\left[1 - \sqrt{1 - \frac{64Q\mu L_{eff}}{P\rho_v h_{fg} A D_h^2}}\right]$$

where:

R=Universal Gas Constant

T=Absolute Temperature $h_{fg}$=Latent heat of vaporization of the working fluid Q=Heat Flow $\mu$=Viscosity of the working fluid $L_{eff}$=Effective length of heat pipe P=Absolute Pressure $\rho_v$=Vapor density A=Cross sectional area of the heat pipe $D_h$=Hydraulic diameter of the heat pipe Vapor temperature drop versus vapor space thickness, using methanol as the working fluid, is shown in FIG. 7. A vapor space thickness of at least 0.25 inch is required which, for methanol, would yield a vapor temperature drop of roughly $1.7\times10^{-2}$° C. Methanol or acetone will satisfy the worst case environmental temperatures for military applications when heat pipes of steel or aluminum, respectively, are used.

The interface between the heat pipe's inner surface and the gun tube is preferably filled with a thin and conformable heat transfer material 72 to reduce air voids and, therefore, to provide a low overall thermal resistance. In this case, the ΔT between top wall 74 and bottom wall 70 of the gun tube would result primarily from variations in thickness of the mating interface material. Controlled tests on clam-shell type heat sinks mated to cylindrical pipes showed interface thickness variations of 0.0025 to 0.006 inch, depending on the particular design and materials. The interface material conforms to both the gun tube and thermal jacket irregularities, using for example silicon or neoprene rubber with a thermal conductivity in the order of 0.1 BTU/hr ft °F. This rubber is permanently attached to the inside diameter of the thermal jacket elements. The assembled total local thickness variation of this rubber liner is held to approximately 0.0025 inch, which in turn limits the local circumferential ΔT to 0.5° F. An overall muzzle position change of the order of 0.1 mrad results.

Thus, as a distinct advantage of the heat pipe thermal jacket, no insulating material is required to perform the isothermalizing function. As a result, heat transfer from the gun tube to the ambient air is better than that obtained with a bare gun tube, since the heat pipe thermal jacket's outside surface area is greater that that of the bare gun tube. in turn, this more than compensates for the relatively small increase in thermal impedance between the gun tube and the outside surface of the thermal jacket.

Although the invention has been described with reference to particular embodiments thereof, it should be realized that various changes and modifications may be made therein without departing from the spirit and scope of the invention.

What is claimed is:

1. An arrangement for reducing non-symmetrical, thermally induced strains in a gun tube comprising a heat pipe jacket including a pair of clam-shell envelopes with working fluid therein which extend lengthwise of and in thermal engagement with said gun tube and which have both radial and circumferential conductivity, respectively for conducting heat away from and for equalizing temperature gradients about said gun tube, each of said envelopes including an elongated curved inner wall in contact with said gun tube, an elongated curved outer wall spaced from and generally parallel to said inner wall, side and end walls extending between and sealed to said inner and outer walls to establish a generally half cylindrical vapor space in each of said shells, and a wick on said walls surrounding the vapor space.

2. An arrangement according to claim 1 wherein said heat pipe jacket includes a pair of clam-shell envelopes extending lengthwise of said gun tube, each having working fluid therein.

3. An arrangement according to claim 1 further including at least one hinge and one clamp securing said envelopes together at their respective opposite mating edges.

4. An arrangement according to claim 6 wherein said heat pipe jacket includes at least one torus extending around and in contact with said gun tube and having a wick on its inner surfaces and working fluid therein.

5. An arrangement for reducing non-symmetrical, thermally induced strains in a gun tube comprising a heat pipe jacket including at least one torus comprising a pair of arcuate tubes respectively having wicks on their inner surfaces and working fluid therein and extending around and in thermal contact with said gun tube to provide both radial and circumferential conductivity, respectively for conducting heat away from and for equalizing temperature gradients about said gun tube.

6. An arrangement according to claim 5 further including a plurality of tori extending around, spaced along the length of, and in contact with said gun tube, each of said tori having a wick on its inner surfaces and a working fluid therein.

7. An arrangement for reducing non-symmetrical, thermally induced strains in a gun tube comprising a heat pipe jacket including a plurality of tori extending around, spaced along the length of, and in contact with said gun tube, each of said tori having a wick on its inner surfaces and a working fluid therein and each comprising a pair of arcuate tubes in thermal engagement with said elongated structure having both radial and circumferential conductivity, respectively for conducting heat away from and for equalizing temperature gradients about said gun tube.

8. An arrangement according to claim 7 further including at least one pair of clam-shell brackets extending lengthwise of said gun tube and supporting respective pairs of said arcuate tubes.

9. An arrangement according to claim 8 further including at least one hinge and ane clamp joining said pair of brackets together at their respective opposite mating edges.

* * * * *